US006350144B1

(12) United States Patent
Afflerbaugh et al.

(10) Patent No.: US 6,350,144 B1
(45) Date of Patent: Feb. 26, 2002

(54) CONTROLLED DISTRIBUTION TERMINAL BLOCK

(75) Inventors: Martin G. Afflerbaugh; Philip M. Smith, both of Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/717,666

(22) Filed: Nov. 21, 2000

(51) Int. Cl.[7] ..... H01R 11/20

(52) U.S. Cl. ..... 439/412; 439/43; 439/404; 439/516; 439/924.1; 439/60

(58) Field of Search ..... 439/43, 404, 412, 439/49, 516, 924.1, 411, 415, 418, 60

(56) References Cited

U.S. PATENT DOCUMENTS

| | | | | |
|---|---|---|---|---|
| 3,202,953 A | | 8/1965 | Bosworth et al. | 339/42 |
| 3,627,942 A | | 12/1971 | Bobb | 200/51.07 |
| 3,663,780 A | | 5/1972 | Golbeck | 200/167 |
| 3,919,495 A | | 11/1975 | Berglund et al. | 179/98 |
| 4,053,719 A | | 10/1977 | Debortoli et al. | 179/98 |
| 4,156,119 A | | 5/1979 | Matthews | 200/51.03 |
| 5,147,218 A | * | 9/1992 | Matthews et al. | 439/404 |
| 5,149,278 A | * | 9/1992 | Waas et al. | 439/412 |
| 6,188,560 B1 | * | 2/2001 | Waas | 361/119 |

* cited by examiner

*Primary Examiner*—Truc T. T. Nguyen
*Assistant Examiner*—Truc Nguyen
(74) *Attorney, Agent, or Firm*—Darla P. Fonseca

(57) ABSTRACT

A communications cable terminal block switching mechanism employs a terminal block housing with a number of chambers and a number of openings for service wires to be inserted into the chambers. A cable stub enters the terminal block and contains feed-in pairs and feed-out pairs. Based on the condition of the switching mechanism, a wire pair may be expressed through the terminal block unterminated, or, a wire pair may be terminated to a service wire at the block. Specifically, a number of sets of electrical contact elements, corresponding to the number of openings, is provided, and one of each of the sets of contact elements is configured in one of each of the chambers. Actuator mechanisms, corresponding to the number of chambers, are each coupled to a respective one of the chambers and each is adapted to move components within the chamber such that electrical connections between a wire inserted into the chamber and the corresponding set of electrical contact elements are altered based on movement of the actuator mechanism.

13 Claims, 3 Drawing Sheets

CONTROLLED DISTRIBUTION TERMINAL BLOCK

FIELD OF THE INVENTION

The present invention relates generally to a communications cable terminal block, and, more particularly, to a communications cable terminal block switching mechanism that allows a wire pair to be expressed through, in effect bypassing the terminal block, or to be terminated to a service wire at the block.

BACKGROUND OF THE INVENTION

Terminal blocks are typically used in the telecommunications industry to connect multiple wire pairs, for example, to connect telephone service wires to telephone company distribution cables. Such terminal blocks typically connect from 2 to 50 individual service wire pairs to the distribution cable which may have several thousand wire pairs. Generally, the terminal block is spliced to the distribution cable through a splicing cable or stub cable which forms part of the terminal block. The customer service wires are then connected to the terminal blocks through some type of terminal which, ideally, enables the service wires to be easily connected, disconnected and reconnected on site.

A number of approaches to connect the service wire pairs to the terminal block have been described in U.S. Pat. No. 5,149,278 (Waas et al.). The '278 patent describes one technique in which a stripped service wire is connected to a binding post and secured with a cap. Another technique noted in the '278 patent is the use of an insulation displacement contact terminal in which the insulation is severed by a blade as the service wire is secured to the terminal. The blade then also acts as the contact connecting the service wire conductor to the cable. In this case, the service wire is also further secured by a cap.

However, each of the approaches in the '278 patent address only the need for an easy method of connecting a service wire to a terminal block. These techniques do not address the potential need to take a distribution cable pair that has been connected to a service wire at the terminal block, and easily disconnect the cable pair from the service wire and reconnect the cable pair to the downstream distribution cable. In each of the approaches discussed in the '278 patent, for example, once the distribution cable pair has been connected to a service wire at the terminal block, in order for that pair to be disconnected from the service wire and "reconnected" to the downstream distribution cable, the pair would need to be removed from the terminal block and re-spliced to the downstream cable. This is both time consuming and likely to require re-opening the original splice, resulting in greater likelihood of potentially harmful exposure of the final splice to the outside environment.

The present invention is therefore directed to the problem of developing a controlled distribution communications cable terminal block in which a mechanism is provided that allows a wire pair of a telephone company distribution cable to easily switch between two conditions, the first condition having the wire pair terminated to a service wire at a terminal block, and the second condition having the wire pair express through without termination, or "bypass", the terminal block.

SUMMARY OF THE INVENTION

The present invention solves these problems by implementing a communications cable terminal block switching mechanism in a terminal block housing with a number of chambers and a number of openings for service wires to be inserted into the chambers. Based on the condition of the switching mechanism, a wire pair may be expressed through the terminal block unterminated, or, a wire pair may be terminated to a service wire at the block.

More specifically, the switching mechanism of the present invention provides a number of sets of electrical contact elements, corresponding to the number of openings in the block. Each of the sets of contact elements is configured in one of each of the chambers. An actuator mechanism is coupled to one of the chambers and is adapted to move components within the chamber such that electrical connections between a wire inserted into the chamber and the corresponding set of electrical contact elements are altered based on movement of the actuator mechanism.

According to one aspect of the present invention, each of the chambers has a base, into which a set of the electrical contact elements is inserted, a chamber housing, attached to the base, having an opening for the actuator mechanism and a molded body, inside the chamber housing, having an external threaded portion.

In another aspect of the present invention, the actuator mechanism is a cap, having an outer portion extending outside of the terminal block housing, and an inner threaded portion extending into the chamber housing, aligning with the external threaded portion of the molded body in the chamber.

In one particular embodiment of the present invention, rotating the cap causes the body of the chamber to move perpendicularly to a plane of the base and the plane of rotation of the cap.

In yet another aspect of the present invention, each set of electrical contact elements includes an incoming element, an outgoing element, a drop wire element and a bridging element. The incoming, outgoing and drop wire elements are each inserted into the base of the chamber, and the bridging element is inserted into the body of the chamber. The bridging element is adapted to move, in accordance with movement of the actuator mechanism, between first and second positions, in each of which different electrical contact elements are electrically connected, thereby providing a controlled distribution terminal block with switching mechanism which enables service wires to be easily connected, disconnected and reconnected on site.

DETAILED DESCRIPTION

In accordance with the present invention, a service wire terminal block includes a switching mechanism that allows a wire pair to be expressed through, in effect bypassing the terminal block, or to be terminated to a service wire at the block, which disconnects the remaining length of the affected wire pair in the cable.

Figure 1:
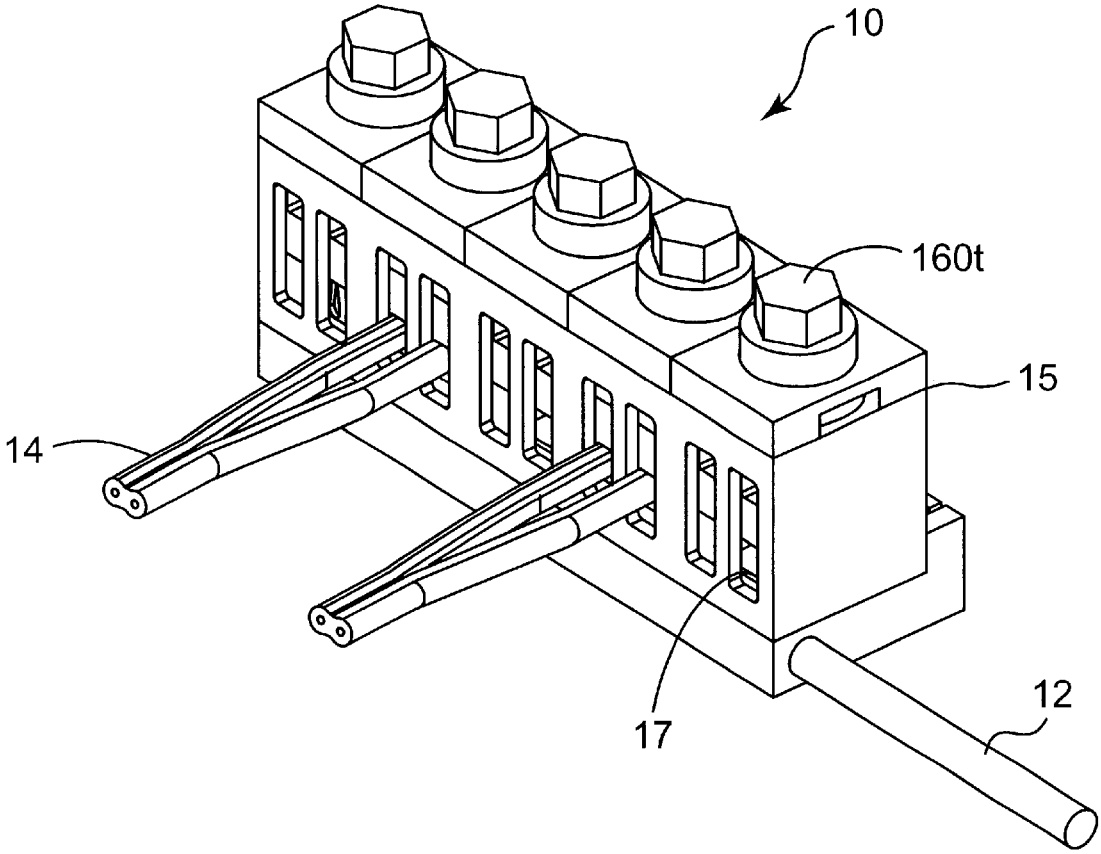
FIG. 1 depicts an isometric view of a five pair version of a controlled distribution terminal block in accordance with the principles of the present invention.

FIG. 1 shows an isometric view of a five pair version of a terminal block 10 according to the present invention. The "outside" view of the terminal block 10 in FIG. 1 includes an elongated housing 15 having a plurality of wire pair openings 17 along a front surface thereof (five such pairs of openings are shown in the illustrative figure). Wire pair openings 17 are spaced apart along the length of housing 15 and provide access for the service wires into isolated chambers within housing 15 of terminal block 10. Housing 15 may be composed of a dielectric material, suitable for manufacture in the desired shape.

The number of wire pair openings 17 in terminal block 10 correspond to the number of internal chambers of the block itself, and will vary with the specific application of the block. FIG. 1 specifically shows a five pair version of a terminal block 10, but it should be appreciated by those skilled in the art that the concepts of the invention are applicable to a terminal block having any number of wire pairs. For example, in conventional telecommunication applications that provide service wire drop connections to telephone distribution cables, 2 to 50 pairs of service wires are typically connected by a single terminal block. However, other applications, including non-telecommunication applications, may require a different number of service wire drop connections. In addition, various applications may in fact require and employ a single-wire opening rather than "pairs of openings" for each internal chamber. In other applications, additional wire openings, to the "pair" of openings into each chamber may be required.

Accordingly, the specific configuration of the housing and wire pair openings of the terminal block shown in FIG. 1 is an illustrative embodiment only, and may be varied as needed for specific applications of the inventive terminal block switching mechanism.

Also shown in the isometric view of terminal block 10 in FIG. 1 is a top portion 160*t*, of each of a series of caps 160 (shown in FIG. 2 and discussed below) with internal threads, located along the top of housing 15. The bottom portion of caps 160 extend into housing 15 into the corresponding chamber (the specific function and operation of cap 160 will be described in greater detail below). The number of caps 160 are equal to the number of chambers contained within terminal block 10 and each cap 160 is positioned over the corresponding isolated chamber.

Still referring to FIG. 1, a cable stub 12 (or "unjacketed pigtails"), enters one end of the terminal block 10, and typically contains two wire pairs for each internal chamber of the terminal block (or, in this case, the cable stub contains 10 wire pairs total). One of the pairs, corresponding to each internal chamber of the terminal block, the "feed in" pair, is spliced to the cable pair coming from the central office. The other pair, corresponding to each internal chamber of the terminal block, the "feed out" pair, is spliced to the remaining length of the cable pair subsequent to the terminal block 10.

As shown in FIG. 1, the "service wire pairs" or "drop wires" 14 are inserted into wire pair openings 17 (on the left side of terminal block 10 as shown). In operation, after the service wires 14 are inserted, the hex, or cap 160, on the top of the block is turned with, for example, a 216 tool (can wrench) or a generic socket or end wrench of appropriate size, driving service wires 14 into "insulation displacement contact" (IDC) slots of elements inside the block, as will be described in greater detail below. It should be appreciated that the cap 160 could be of any known configuration, for example, cap 160 could also be configured so as to be turned with a basic screwdriver.

Figure 2:
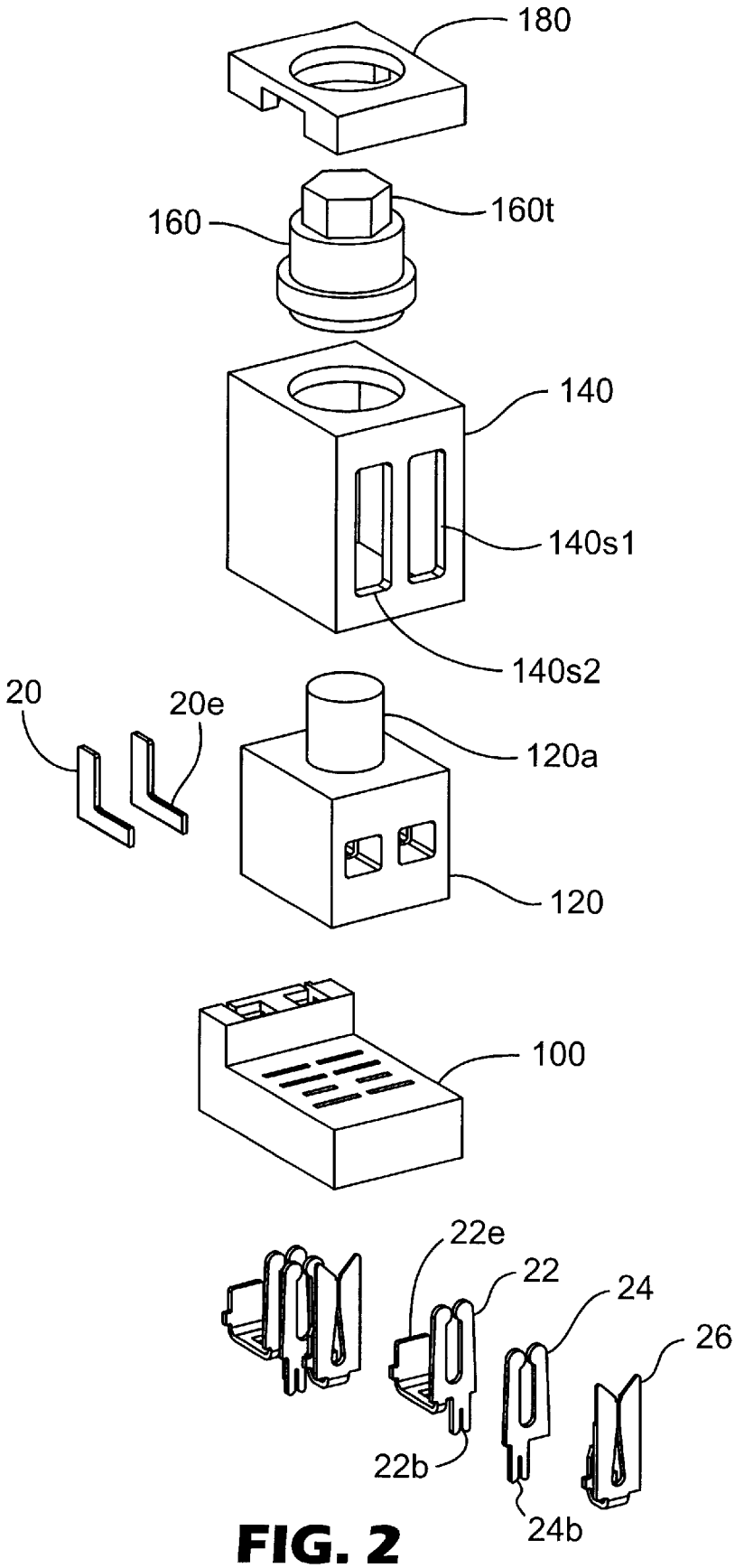
FIG. 2 depicts an isometric exploded view of the components of a single internal chamber.
Figure 3:
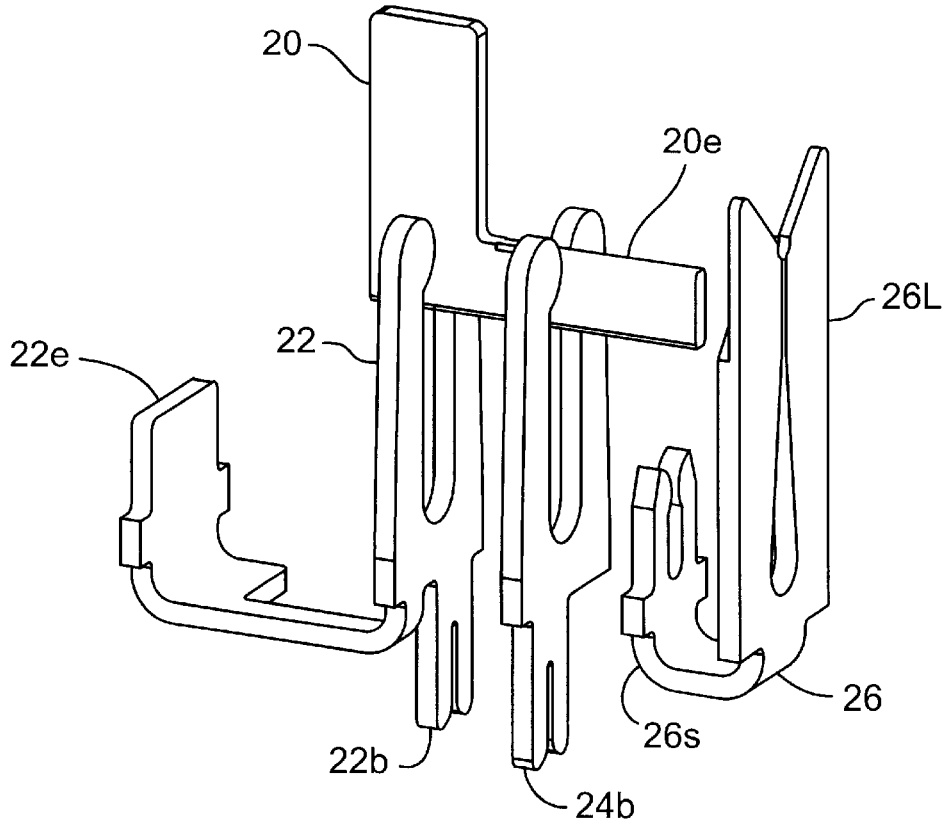
FIG. 3 depicts the elements inside the terminal block illustrating the 'expressed through' configuration.

FIG. 2 shows an isometric exploded view of the essential components of a single internal chamber of a terminal block including the novel switching mechanism, the operation of which is described in detail below. The incoming 22, outgoing 24, and drop wire 26 elements are inserted into a molded base 100 from behind (or from the "bottom" as shown in FIG. 2), and are held in place by barbs or similar retention devices. A set of elements is provided for each service wire in the pair. Note that in FIG. 2, for illustrative purposes and for easier reference, these elements are shown aligned with the slots in base 100 for the service wire of opening 140S1 of housing 140 (described in greater detail below), but in an exploded view for the slots corresponding to opening 140S2. Feed in and feed out wires are terminated in the bottom IDC slots of incoming 22 and outgoing 24 elements, respectively (illustrated as 22*b* and 24*b*), and the base 100 is filled with an insulating potting compound to provide environmental and mechanical protection for the connections (it should be appreciated by those skilled in the art that although the termination devices for the feed in and feed out wires are shown in FIGS. 2 and 3 as IDC slots, any known means of termination for these wires may be used with the switching mechanism described herein). An extension of the incoming element 22 provides a blade 22*e* for test access to the circuit from outside the block, via industry standard alligator clips.

A housing 140 is attached to the front of the top of base 100, and inside the housing is body 120. The housing 140 and body 120 are sized so that the body 120 can move inside the housing in a direction perpendicular to the plane of the base 100, but is held in alignment in the other two orthogonal directions. Two "L-shaped" bridging elements 20 are installed in the body 120 from the back (the "bottom" of each of the L-shaped bridging elements is labeled 20*e*). There are two openings in the front of the body 120 to accommodate the tip and ring conductors of a service wire pair when inserted through clearance slots provided in housing wall 140 (these clearance slots align with wire pair openings 17 of FIG. 1). The interior spaces of the housing 140 and body 120 may be filled with an insulating grease or gel to provide protection of the elements from environmental attack.

An externally threaded extension 120*a* on the top of the body 120 extends through an opening in the top surface of the housing 140, and is threaded into a cap 160 (for example, with a hexagonal driver designed for use with a standard 216 tool or "can wrench"). The top of cap 160, 160*t*, extends through a retainer 180, which is secured to the top of housing 140 and which holds the cap 160 in place but allows it to rotate.

Figure 4:
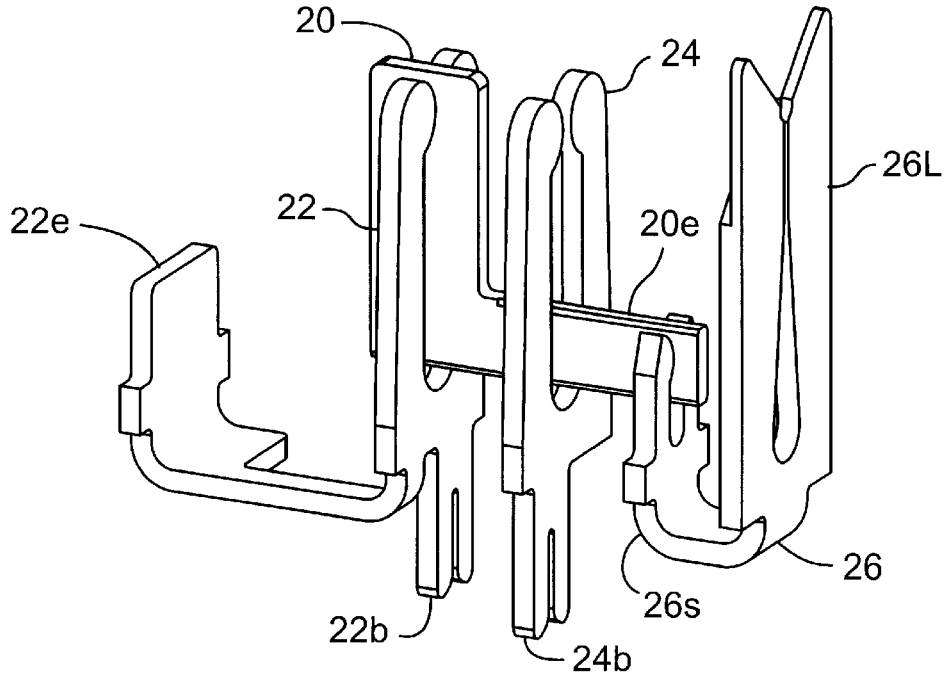
FIG. 4 depicts the elements inside the terminal block illustrating the 'terminated' configuration.

In view of the foregoing structural description of the terminal block of the present invention, its functional features may be readily appreciated in consideration of the description of FIGS. 1 and 2 together with the following description of FIGS. 3 and 4.

Still referring to FIG. 2, when the cap 160 is turned, for example with a can wrench, the body 120 is caused to move axially with respect to the threaded extension 120*a*. Such a motion of the body 120 towards the base 100, with a service wire inserted into the body 120 through the housing slots (illustrated as 140S1 and 140S2), causes both the service wire conductors to be pushed into the IDC slots on the longer arm 26L of drop wire elements 26, and the bridging elements 20 to move from the position shown in FIG. 3 to the position shown in FIG. 4. More particularly, the pressure of the body 120 moving toward base 100, in the direction perpendicular to the plane of the base, causes the service wire 14 and the bridging element 20 to move downward with the body 120 (however, it should be noted that there is no contact between the service wire and the bridging element as the bottom extension 20*e* of bridging element 20 is positioned "below" and parallel to the service wire receptacles in the body). This movement of bridging element 20 connects the service wires to the feed in wires and isolates the feed out wires, and is described in further detail below.

More particularly, FIG. 3 provides a more detailed illustration of the basic elements of the switching mechanism of a terminal block according to the present invention. Specifically, bridging element 20, incoming element 22, outgoing element 24 and drop wire element 26 are shown. Two of these switching arrangements, or "sets" of elements are provided for each pair represented on the block, one set for "tip" and one set for "ring" (in this case, five pairs are represented on the block, and therefore ten total switching arrangements, or sets of elements, would be provided). FIG. 3 illustrates the "expressed through" configuration in which the "feed in" and "feed out" wires pass through the terminal block, and the drop wire element 26 is isolated from these wires.

In operation, the cable stub "feed in" wires, spliced to the cable pair coming from the central office, are terminated in the bottom IDC slots 22*b* on the incoming elements 22. The cable stub "feed out" wires, spliced to the remaining length of the cable pair subsequent to the terminal block 10, are terminated in the IDC slots 24*b* of the outgoing elements 24 (again, although IDC slots are shown as the device for connecting the feed-in and feed out wires to the incoming and outgoing elements respectively, this is for illustrative purposes only, and any means of connection may be used).

Initially, in the field, the service or "drop" wires 14 that are to be connected to the splice cable, or "feed in" pair, are inserted into wire pair opening 17 with the elements in the configuration of FIG. 3. In this configuration, i.e., when the elements are in the "expressed through" configuration, the incoming 22 and outgoing 24 elements are connected by the bridging element 20, which is captured in "fork and blade" style by each of them. Again, while the elements are in this configuration, the wires are expressed through the block and the drop wire element 26 is electrically isolated from the wires.

Now turning to FIG. 4, when the service wire is installed, the user of the terminal block 10 rotates cap 160, which in turn causes body 120 to move axially with respect to the threaded extension 120*a*. This motion of the body 120 toward the base 100, with the service wire inserted into body 120 through housing slots 140S1 and 140S2, drives the corresponding service wire into the IDC slot on the longer arm 26L of the drop wire element. As the service wire is pushed into the IDC slot on the longer arm 26L of the drop wire element 26, by the movement of body 120, the bridging element 20 also travels downward. This motion causes the upper portion of the L-shaped bridging element 20 to remain in contact with the tuning fork of the incoming element 22 while the lower portion 20*e* of the L-shaped bridging element 20 is "released" from contact with the tuning fork of the outgoing element 24. At the end of its travel, the bridging element 20 enters the tuning fork on the shorter arm 26S of the drop wire element 26, thereby connecting the incoming element 22 to the drop wire element 26 and electrically isolating the outgoing element 24.

The reverse motion will, similarly, remove the service wire from the IDC slot on the longer arm 26L of the drop wire element 26, isolate the drop wire element 26 and reconnect the outgoing element 24 to the incoming element 22. More particularly, when the service wire is to be removed or "uninstalled" from the block, the user of the terminal block 10 rotates cap 160 in the reverse direction, which in turn causes body 120 to move in the reverse direction with respect to the threaded extension 120*a* (i.e., perpendicularly away from the plane of the base 100). This motion of the body 120 away from the base 100, with the service wire inserted into body 120 through housing slots 140S1 and 140S2, removes the corresponding service wire from the IDC slot on the longer arm 26L of drop wire element 26. As the service wire is removed from the IDC slot on the longer arm 26L of the drop wire element 26, the bridging element 20 again travels along with the service wire (due to the motion of the body 120 with respect to the base 100). This motion causes the bridging element 20 to remain in the tuning fork of the incoming element 22 while also contacting the tuning fork of the outgoing element 24 and exiting the tuning fork on the shorter arm 26S of the drop wire element 26, thereby reconnecting the incoming element 22 to the outgoing element 24 and electrically isolating the drop wire element 26.

Accordingly, it will be appreciated that the terminal block of the present invention provides an uncomplicated means of modifying wire connections and allows for simple multiple connection and reconnection of service wires to the terminal block. In addition, a terminal block in accordance with the preferred embodiments is mechanically simple to use, dependable and is not prone to failure even after repeated connections.

Although various embodiments are specifically illustrated and described herein, it will be appreciated that modifications and variations of the present invention are covered by the above teachings and within the purview of the appended claims without departing from the spirit and intended scope of the invention. For example but without limitation, as previously mentioned, the terminal block might have two rows of pairs back to back, so that service wires may approach the block from both sides of the block.

In addition, the present invention is equally applicable to terminal blocks having any number of pairs represented on the block, and the switching mechanism may be implemented in all, or only some, of the individual chambers of the terminal block. It is also applicable to the use of any termination means for terminating both the feed in and feed out wires to the incoming and outgoing elements, respectively. Also, although the cable stub is illustrated as entering the block at a particular end of the block, the cable stub may of course enter the block at any end and any point.

Finally, although the invention has been described with reference to a terminal block for the telecommunications industries, it should be appreciated that the specific switching mechanism described herein is suitable for any type of application that requires electrical wire connections that can be easily switched from an expressed through condition, in which the wire passes through the switching mechanism unaffected, to a terminated condition, in which the wire is disconnected from the remaining length of wire and is terminated to a different wire.

What is claimed is:

1. A controlled distribution terminal block comprising:

a terminal block housing having at least one chamber and at least one opening for a wire to be inserted into said at least one chamber;

at least one set of electrical contact elements, said at least one set corresponding to the number of said at least one opening, one of each of said at least one set of contact elements configured in one of each of said at least one chamber; and at least one actuator mechanism, corresponding to the number of said at least one chamber, each actuator mechanism coupled to a respective one of said chambers and adapted to move components within the chamber such that electrical connections between a wire inserted into said chamber and said corresponding set of electrical contact elements are altered based on movement of said actuator mechanism; wherein each of said contact elements comprises an incoming element, an out going element, a drop wire element and a bridging element;

wherein said in said incoming element, said outgoing element and said drop wire element are inserted into said base of said chamber;

wherein said briding element is inserted into said body of said chamber, and wherein said bridging element is adapted to move, in accordance with movement of said actuator mechanism, between first and second position;

wherein in the first position, said bridging element is electrically connecting said incoming element and said outgoing element and drop wire element is electrically isolated.

2. A terminal block according to claim 1, wherein each of said at least one chamber comprises:

a base, into which a set of said electrical contact elements is inserted;

a chamber housing, attached to said base, having an opening for said actuator mechanism; and a molded body, inside said chamber housing, said body having an external threaded portion.

3. A terminal block according to claim 2, wherein said actuator mechanism comprises:

a cap, having an outer portion, extending outside of said terminal block housing, and an inner threaded portion, extending into said chamber housing, aligning with the external threaded portion of said molded body in said chamber.

4. A terminal block according to claim 3, wherein rotating said cap causes said body of said chamber to move perpendicularly to a plane of said base and the plane of rotation of said cap.

5. A terminal block according to claim 1, wherein said bridging element is in the second position, electrically connecting said incoming element and said drop wire element.

6. A terminal block according to claim 5, wherein said outgoing element is electrically isolated.

7. A terminal block according to claim 1, wherein said incoming element includes an extension blade that extends outside of said chamber when mounted in said chamber.

8. A terminal block according to claim 1, wherein said drop wire element has two arms, one longer arm and one shorter arm.

9. A terminal block according to claim 8, wherein in said second position, said longer arm engages a service wire and said shorter arm engages said bridging element.

10. A terminal block switching mechanism comprising:

a plurality of electrical contact elements; and a bridging element, wherein said bridging element is adapted to move between first and second positions in each of which different of said plurality of electrical contact elements are electrically connected, and further wherein in one of said first or second positions said bridging element electrically connects a wire inserted into the terminal block into one of said plurality of electrical contact elements to another of said plurality of electrical contact elements; wherein said plurality of electrical contact elements comprises an incoming element; and outgoing element, and a drop wire element, said drop wire element receiving a wire inserted into the terminal block; and wherein said bridging element is in the first position, electrically connecting said incoming element and said outgoing element, and further wherein said drop wire element is electrically isolated; and wherein said bridging element is in the second position, electrically connecting said incoming element and said drop wire element, and further wherein said outgoing element is electrically isolated.

11. A terminal block switching mechanism according to claim 10, wherein said incoming element includes an extension blade.

12. A terminal block switching mechanism according to claim 10, wherein said drop wire element has two arms, one longer arm and one shorter arm.

13. A terminal block switching mechanism according to claim 12, wherein in said second position, said longer arm engages a wire inserted into the terminal block and said shorter arm engages said bridging element.

* * * * *